United States Patent [19]

Lane

[11] Patent Number: 4,554,883

[45] Date of Patent: Nov. 26, 1985

[54] MODULAR FLOATING STRUCTURE

[76] Inventor: Wallace W. Lane, 579 Auwina Ave., Kailua, Hi. 96734

[21] Appl. No.: 503,038

[22] Filed: Jun. 10, 1983

[51] Int. Cl.[4] ..... B63B 35/38

[52] U.S. Cl. ..... 114/266

[58] Field of Search ..... 114/264, 265, 266, 258; 405/195, 197, 203, 204, 205, 206, 207, 208

[56] References Cited

U.S. PATENT DOCUMENTS

| | | | |
|---|---|---|---|
| 3,289,621 | 12/1966 | Sebring | 114/266 |
| 3,507,239 | 4/1970 | Wipkink et al. | 114/265 |
| 4,437,794 | 3/1984 | Grimsley et al. | 405/203 |

*Primary Examiner*—Trygve M. Blix
*Assistant Examiner*—Jesus D. Sotelo
*Attorney, Agent, or Firm*—Flehr, Hohbach, Test, Albritton & Herbert

[57] ABSTRACT

A multipurpose floating structure usable as a floating airport or as a floating support for an industrial facility. The structure is made of numerous identical modular units joined in a reticulated pattern. Each modular unit has a removable self-draining deck, groups of removable flotation tanks, a grid framework of beams and girders for holding the tanks and supporting the deck, and a submerged bridging network providing rigid support and stability for the structure. The components are made primarily of waterproofed steel reinforced concrete. The flotation tanks are accessible for purposes of inspection and maintenance, and for adjusting the level of ballast therein.

19 Claims, 26 Drawing Figures

MODULAR FLOATING STRUCTURE

This invention relates generally to floating structures and more particularly to a multipurpose floating structure made up of flotation units joined together in a regular pattern. A floating structure of this character can be used in a wide variety of applications. Applications include a floating airport, a floating support for fuel storage tanks, and a floating support for an industrial facility such as a fish processing plant.

The prior patent art in flotation structures includes a variety of modular structures. Some are oriented toward dock type facilities such as piers and rafts, e.g., Williams U.S. Pat. No. 3,009,326, Tellefsen U.S. Pat. No. 3,012,533, Thompson U.S. Pat. No. 4,041,716, Finsterwalder U.S. Pat. No. 4,097,948, and Dunlop U.S. Pat. No. 4,223,629. At least one is oriented toward creating a bouyant barrier for encircling a spillage of oil or other debris, i.e., Rogers U.S. Pat. No. 4,320,991; and at least one is intended to function as a breakwater pontoon, i.e., Olsen U.S. Pat. No. 3,777,689. Finally, there are a few oriented at large flotation structures suitable for use as an airport, e.g., Kurfiss U.S. Pat. No. 2,430,178, Byrne U.S. Pat. No. 2,481,821, Jones U.S. Pat. No. 4,067,285 ("floating island"; no reference to airport facility), and Matsui U.S. Pat. No. 4,286,538. Limitations on the usefulness of each of these include unacceptable wave-action stability and the difficulty or inability to replace damaged floats. Each also contains one or more of the following limitations or deficiencies: rust or corrosion problems, high maintenance cost, insufficient loading capability, limitation in platform area, and non-self-draining deck.

It is an object of this invention to provide a multipurpose floating structure that can either be assembled from prefabricated parts or can be fabricated on site. Other objects of this invention are to provide modular floating structures that can be joined together to form large stable platforms of various types and proportions for an airport or industrial facility, to provide a durable corrosion resistant structure which is stable even in harsh weather conditions, and to provide a low maintenance cost, modular unit whose constituent parts are easily replaced.

In its most basic form the invention comprises a plurality of identical geometrically shaped flotation units joined together to form a regular pattern. Each modular unit is made up of four major parts: a deck, a grid framework of beams and girders, groups of flotation tanks, and a submerged bridging network. The deck is self-draining, permitting deck water to drain freely through concealed ports, and yet provides a suitable surface for walking, driving vehicles and landing airplanes. The deck is also divided into modules, one covering each group of flotation tanks.

The flotation tanks are arranged in groups of four. The tanks in each group are separated and held in place by spacer bars and a keeper cross in the middle of the group. The spacer bars have surge valves allowing the free drainage of water downward but not upward. A modular floating structure can have any number of groups of float tanks, depending on the size of the float tanks used, the desired size of each module and the desired size of the final floating structure. Anywhere from one to several hundred groups might be employed.

The submerged bridging network provides rigid support and stability for the reticulated beams and girders of the upper modular structure. The submerged corners of each modular flotation structure are connected to long hollow beams which converge at a vertex below the center of the module, thus forming an inverted pyramid shape. The vertices are, in turn, interconnected by a lattice of similar beams. The bridging network helps interconnect the modules, provides vertical orientation stability, provides lateral and torsional strength for each module, and can be assembled underwater.

The invention and objects and features thereof will be more readily apparent from consideration of the following detailed description and appended claims in conjunction with the drawings.

Figure 3A:
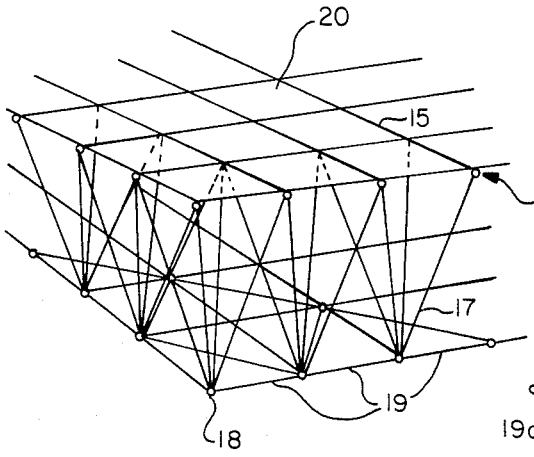
Figure 3B:
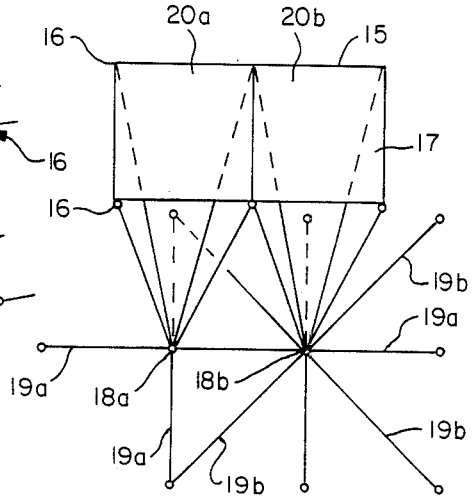
Figure 3C:
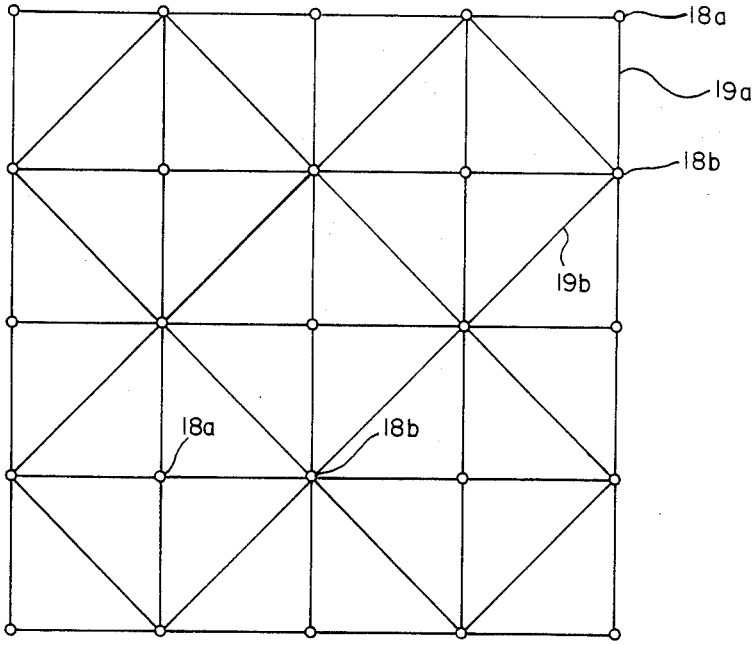

FIGS. 3*a* and 3*b* are perspective views of the submerged bridging network. FIG. 3*c* is a plan view of the horizontal lattice of bottom beams.

Figure 4A:
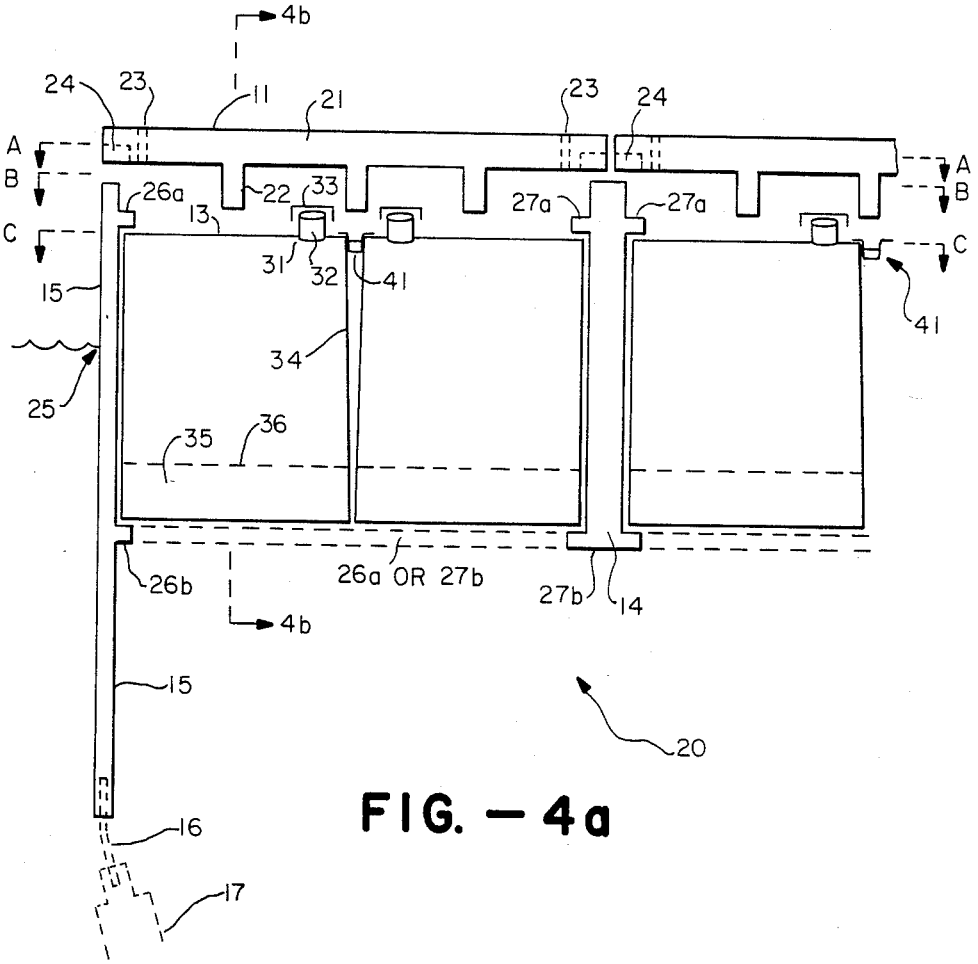
Figure 4B:
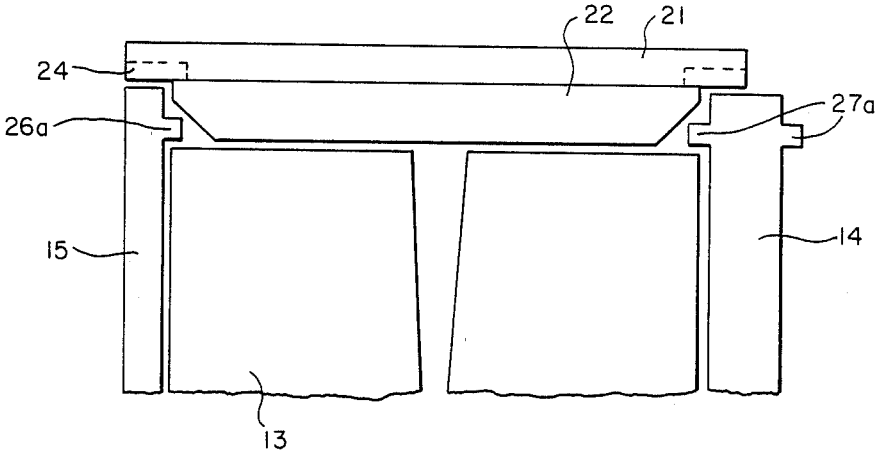

FIGS. 4*a* and 4*b* are fragmentary elevations showing flotation tanks and the components holding them in position.

Figure 5A:
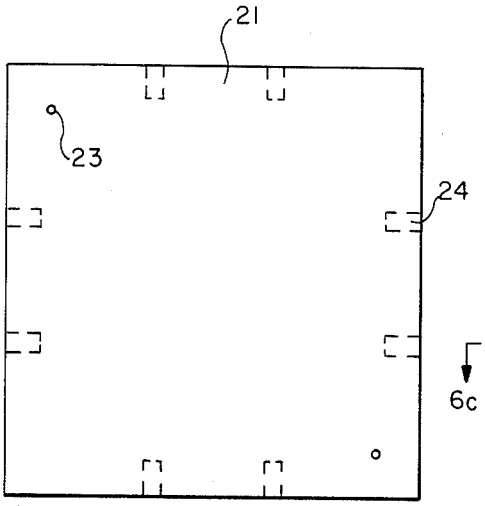
Figure 5C:
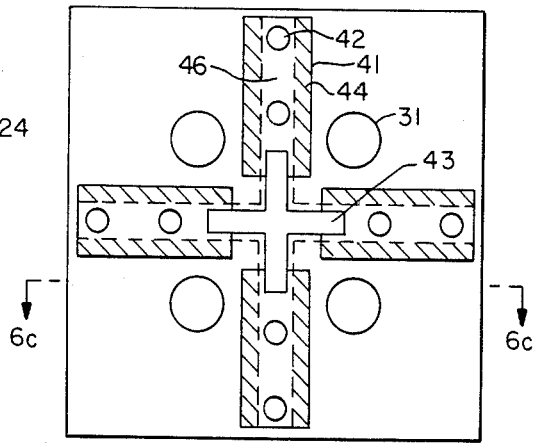
Figure 5B:
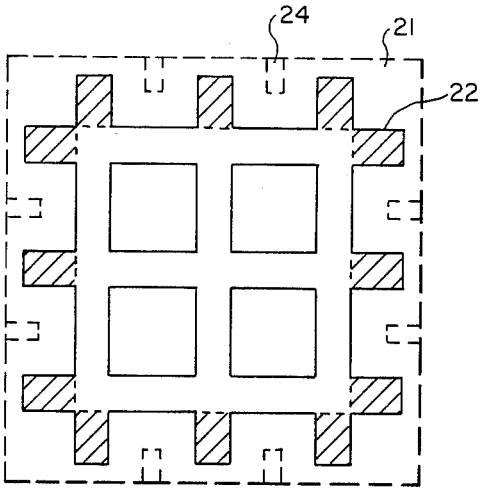

FIGS. 5*a*, 5*b* and 5*c* show three horizontal sections of FIG. 4*a*.

Figure 6A:
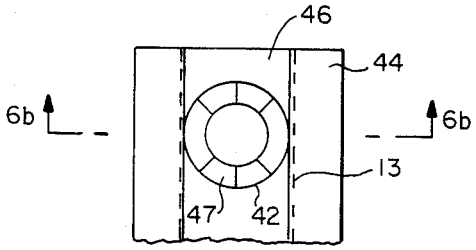
Figure 6B:
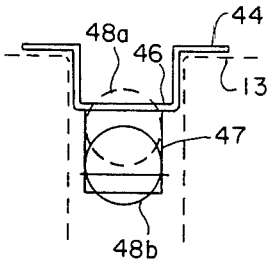
Figure 6C:
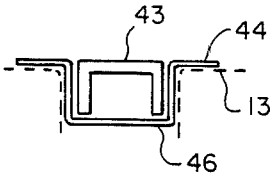

FIGS. 6*a*, 6*b* and 6*c* are three views of spacer bars in conjunction with surge valves and a keeper cross.

Figure 7A:
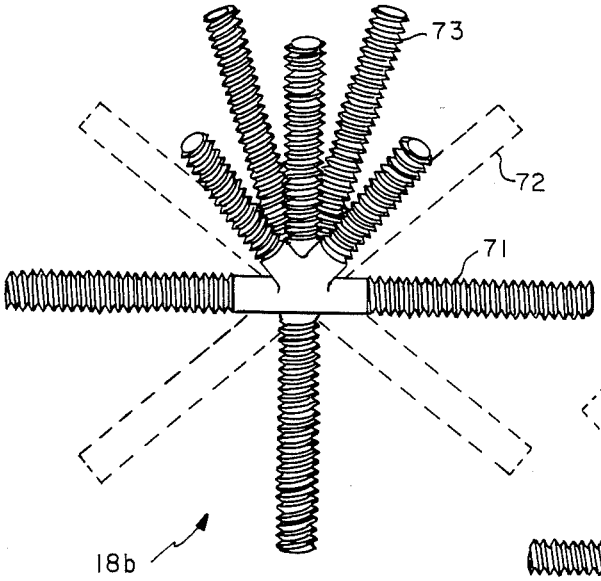
Figure 7B:
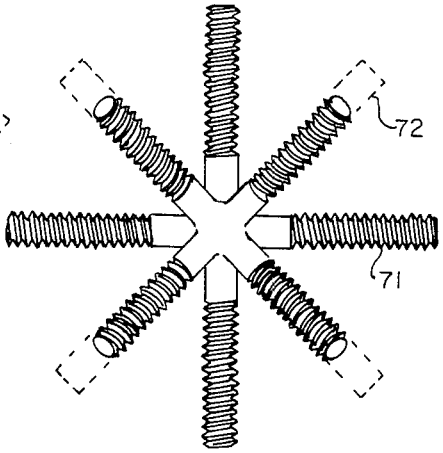
Figure 7D:
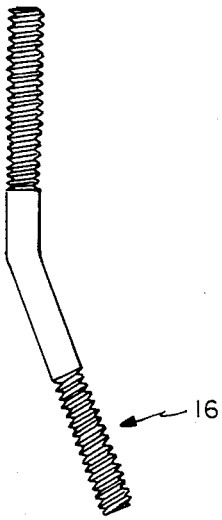
Figure 7C:
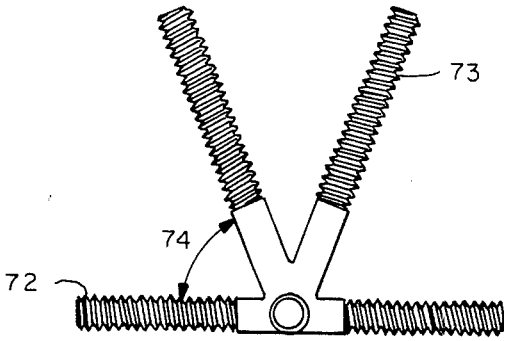

FIGS. 7*a*, 7*b* and 7*c* are series of views of a bottom connector. FIG. 7*d* shows a bridging connector.

Figure 8:
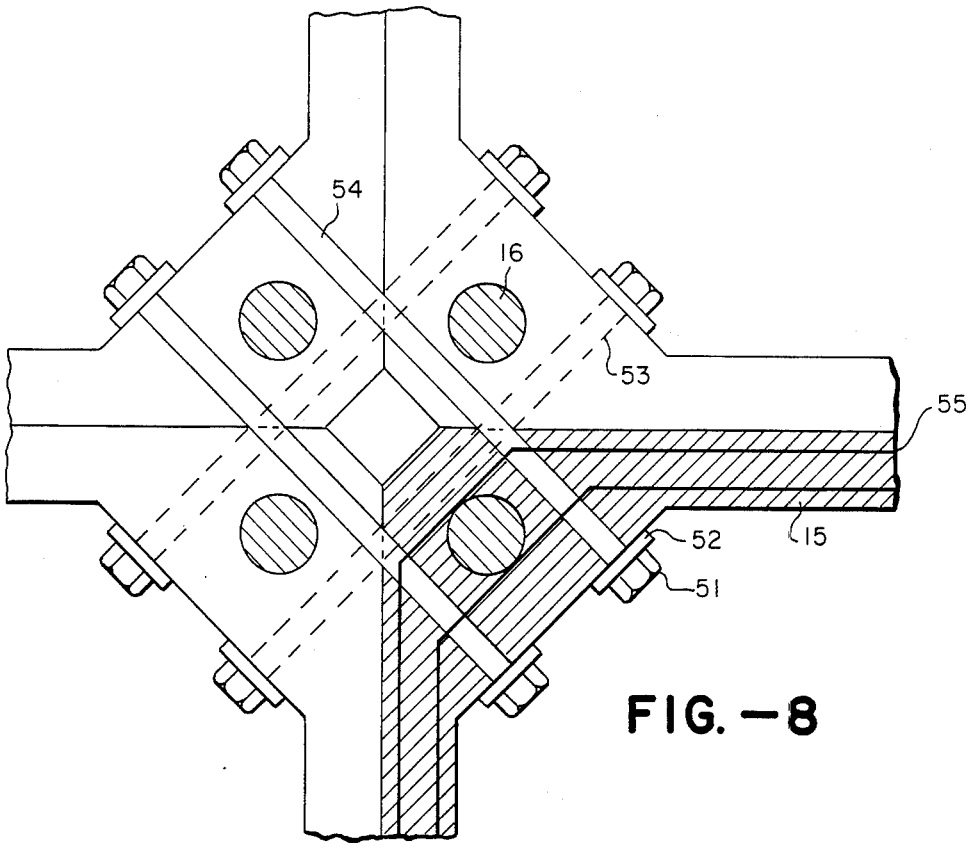

FIG. 8 is a partial sectional view of four interconnected modules.

Figure 9A:
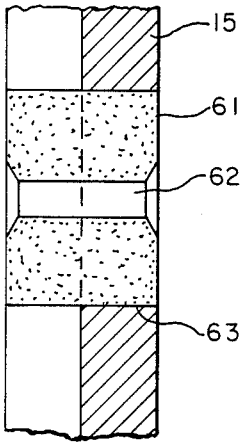
Figure 9B:
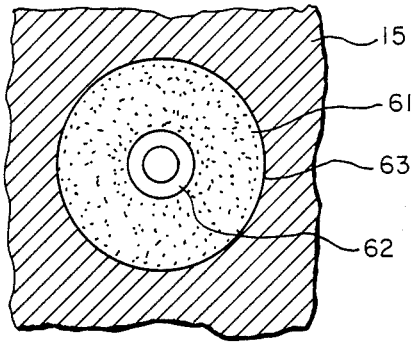

FIGS. 9*a* and 9*b* are two sectional views of a shear block connector between two modules.

Figure 10:
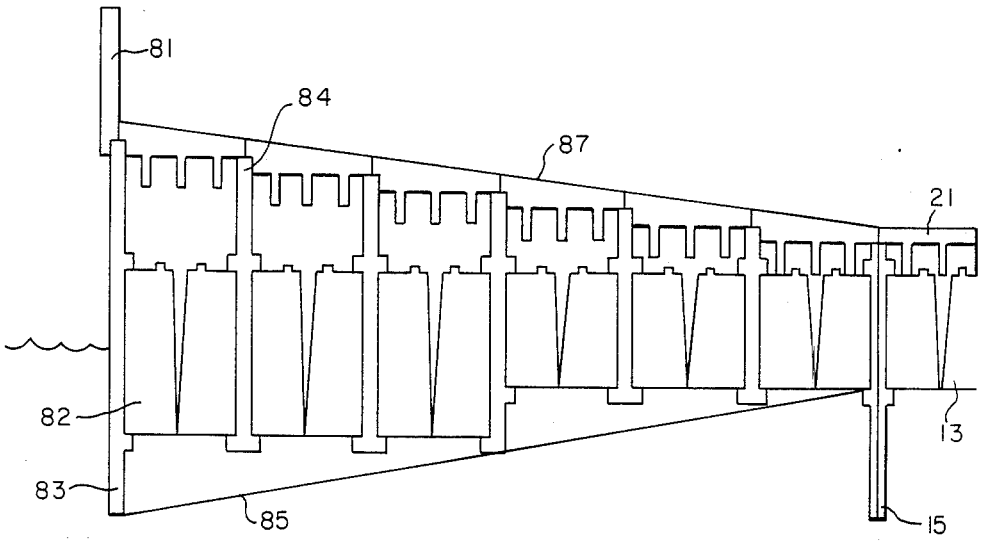

FIG. 10 is a sectional view of an open-sea perimeter wall addition to the modular flotation structure.

Figure 11:
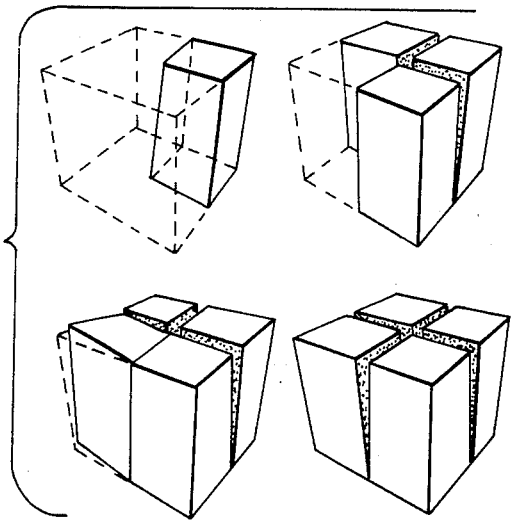

FIG. 11 is a perspective view of the assembly sequence of a tank group.

Figure 12A:
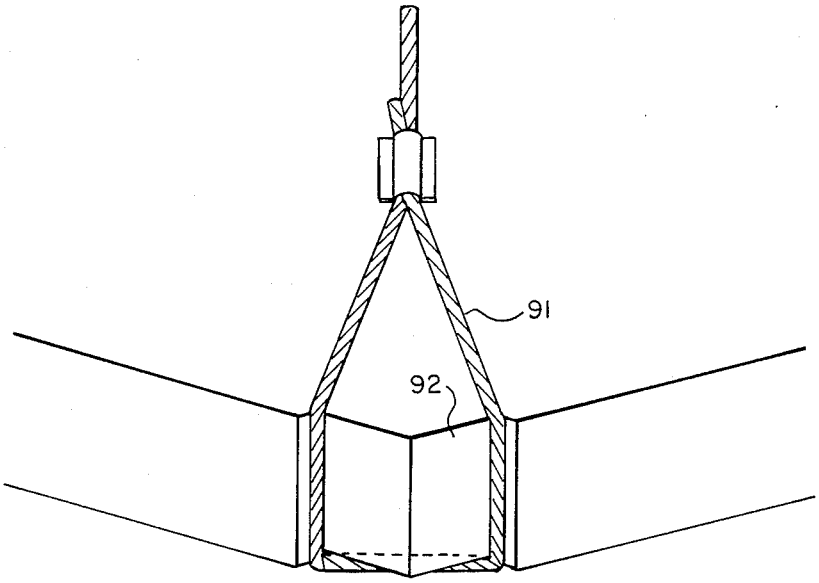
Figure 12C:
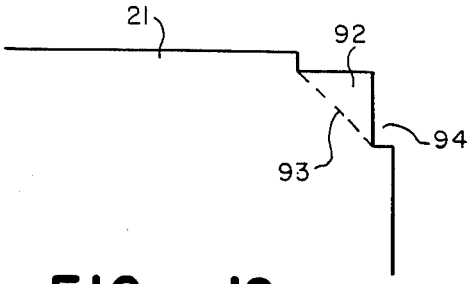
Figure 12B:
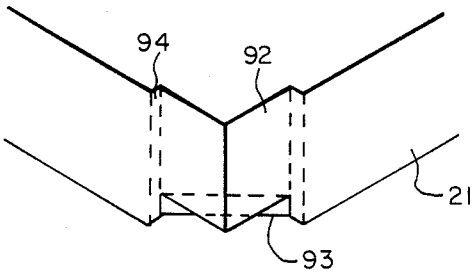
Figure 12C:
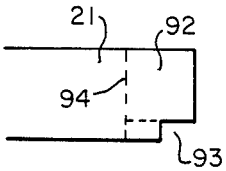

FIG. 12*a* shows a deck module being lifted by a sling. FIG. 12*b* is a perspective view of a modified deck module corner. FIGS. 12*c* and 12*d* are plan and section views, respectively, of the modified deck module corner.

Figure 1:
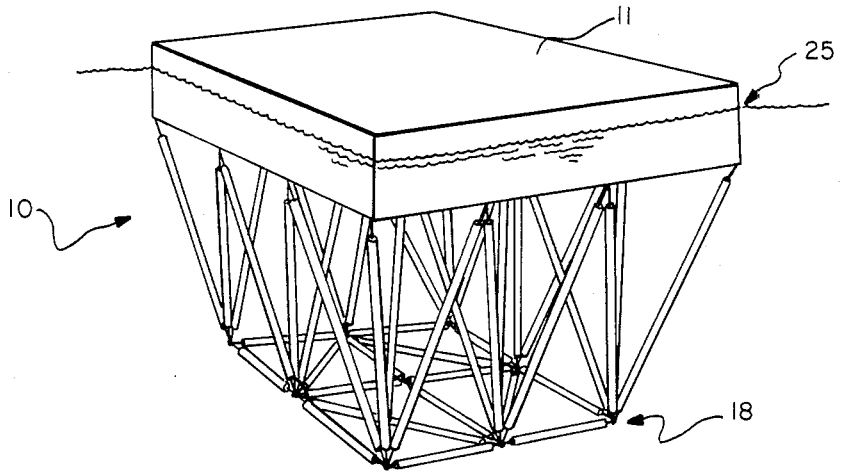
FIG. 1 is a perspective view showing a multipurpose modular flotation structure.

Referring to FIG. 1, there is shown a perspective view of a flotation structure 10. While for purposes of illustration the figure shows only nine modular units (one for each vertex 18 in the submerged bridging network 16–19), in practice a floating airport might use an array of one hundred by thirty modular flotation structures, or more, each with a deck surface 11 measuring approximately thirty feet square.

Figure 2:
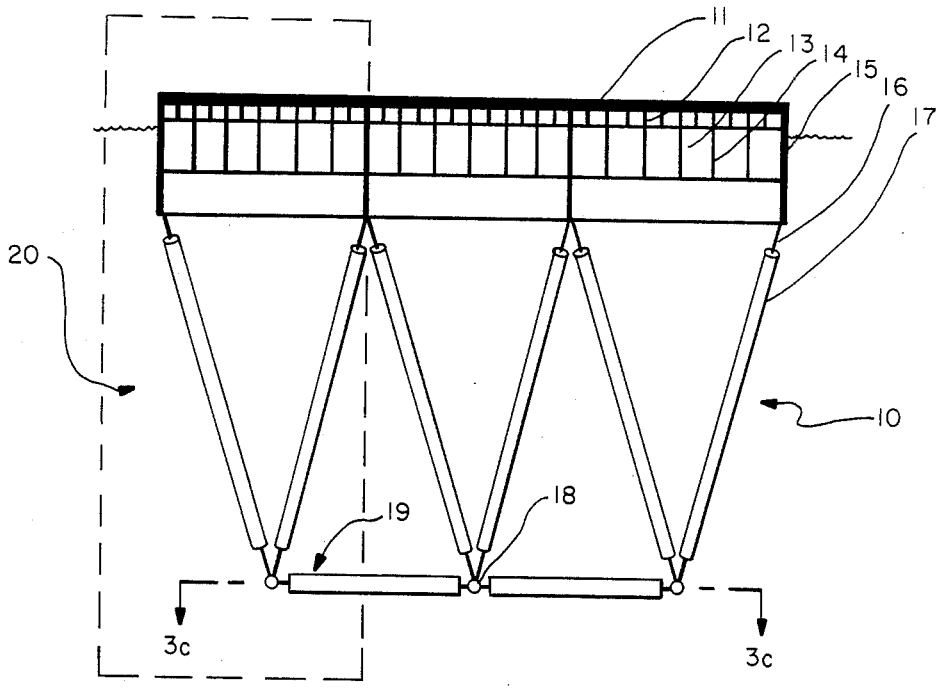
FIG. 2 is an elevation view showing the basic components of the modular flotation structure.

The major components of each modular flotation structure 20, as shown in FIG. 2, are: a joisted self-draining deck 12; groups of flotation tanks 13 held in place by a reticulated grid of side beams 14 and girders 15; and a submerged bridging network comprising bridging connectors 16 to the girders 15, bridging beams 17, bottom beams 19 and bottom connectors 18 which connect the bridging beams 17 from one modular unit to the bottom beam lattice. Each of these major components, and the preferred method of assembly, is described below.

FIG. 3*a* is a perspective view of the submerged bridging network. For each modular flotation structure 20 there is an inverse cone or pyramid of four bridging beams 17 connected to each lower corner of the girders 15 by means of special bridging connectors 16. The four bridging beams 17 converge on a single bottom connector 18 at one vertex in the lower horizontal lattice of bottom beams 19.

FIG. 3*b* shows a perspective view of the submerged bridging network of two adjacent modular floating structures 20*a* and 20*b*. As shown, every bottom connector 18*a* or 18*b* connects to four bridging beams 17 which connect to the four corners of one flotation module 20 in an inverse pyramid. The four bridging beams 17 connected to module 20*a* converge on bottom connector 18*a* which is connected to only four bottom beams 19*a*. On the other hand, the four bridging beams 17 connected to module 20*b* converge on bottom connector 18*b* which is connected to four perpendicular bottom beams 19*a* and also four diagonal bottom beams 19*b*. *FIG. 3c* is a sectional view of the lattice of bottom beams 19*a* and 19*b*. As shown, there are two kinds of bottom connectors 18*a* and 18*b* and two kinds of bottom beams 19*a* and 19*b*. Bottom connectors 18*a* each connect in the horizontal plane to four perpendicular bottom beams 19*a*. Bottom connectors 18*b* each connect in the horizontal plane to four perpendicular bottom beams 19*a* and also four diagonal bottom beams 19*b*. (In addition, every bottom connector 18*a* or 18*b* connects to four bridging beams 17 which connect to the four corners of one flotation module.) By interspersing bottom connectors 18*a* and 18*b* in a checkboard pattern the pattern shown in FIG. 3*c* is achieved. The diagonal bottom beams 19*b* give rigidity by triangular bracing to both the bottom horizontal plane (shown in FIG. 3*c*) and the vertical planes formed with the diagonal bottom beams 19*b* and the bridging beams 17. Thus, the diagonal bottom beams 19*b* provide substantial anti-torque strength to the structure 10.

FIG. 4*a* is an elevation view showing details of the upper left-hand portion of one modular flotation structure 20. The deck 21 is divided into modules, one deck module covering each group of flotation tanks 13. The group of flotation tanks 13 shown on the left is bounded by girder 15 and side beam 14. The group to the right, only partially shown, is bounded only by side beams 14. The deck 21 has a surface 11 which may be modified for the particular planned use of the flotation structure. The other defining characteristics of the deck 21 are (a) drainage means 24 sufficient to promptly drain water from the deck surface and thus keeping the surface usable in harsh sea conditions; (b) lift holes 23 by which the deck modules can be connected to a crane for purposes of assembly and removal for inspection and maintenance; (c) joists 22 for improving deck strength and restraining spacer bars 41 and keeper cross 43 (see FIG. 5*c*). The lift holes 23 may be omitted where the deck modules are to be lifted by slings or electromagnets.

The flotation tank 13 is a rectangular six-sided box with an aperture 31 and neck 32 on the upper side, and a cap 33 over the neck. The neck 32 permits visual inspection of the tank 13 and the addition or removal of ballast 35 from the flotation tank 13 as needed. The ballast level 36 will determine the water level 25 on the device 10.

The two vertical sides 34 of each flotation tank 13 which face inward towards the spacer bars 41 are tapered so as to be slightly narrower at the top than the bottom. The tapering leaves room for spacer bars 41 between the upper edges of adjacent tanks 13 in each group. The spacer bars 41 not only help keep the tanks 13 in position, but also facilitate drainage of water from the deck (see FIGS. 5*c*, 6*a* and 6*b*). The tapering is also essential for the assembly of the modular flotation structure, as discussed below.

The girders 15 and side beams 14 for each modular structure 10 are formed as a single integral unit. They have upper and lower ledges 26*a*, 26*b*, 27*a*, 27*b* which hold the flotation tanks in place. Thus the combined structure is floating and no other bottom flotation support is necessary.

The side beams 14 and girders 15 extend vertically to meet the deck 21. The girders extend vertically downward to form a junction with the submerged bridging network via the bridging connectors 16. The bridging connectors 16 are welded to the steel reinforcing in the concrete walls of the girders 15 (see FIG. 8).

FIG. 4*b* is a partial sectional view of the modular flotation structure, demarked as 4*b* in FIG. 4*a*. As shown, the joist 22 tapers upwards at each end. The taper leaves room for ledges 26*a* and 27*a*. The joist 22 stops just short of and abuts the girder 15 and side beam 14. Thus the deck sits on top of the girders 15 and side beams 14 but cannot slide out of position.

FIGS. 5*a*, 5*b* and 5*c* are partial sectional views of a modular flotation structure at three different horizontal levels, demarked as A, B and C in FIG. 4*a*.

FIG. 5*a* shows the deck surface 11, concealed drainage ports 24 and lift holes 23. FIG. 5*b* shows the joists 22 below the deck surface that help hold the flotation tanks 13 and spacer bars 41 in place. The cross-hatched portions of the joists 22 correspond to the tapered ends of the joists as shown in FIG. 4*b*.

FIG. 5*b* also shows the spacial relationship of the concealed drainage ports 24 relative to the joists. Water drains from the deck through the crack between deck modules and into the concealed drainage ports 24. From there the water can drain from the top surface of the tanks 13 and through the surge valves in the spacer bars 41 (see FIGS. 6*a* and 6*b*).

FIG. 5*c* shows the spacial relationship of four flotation tanks 13, spacer bars 41, surge valves 42, keeper cross 43 and tank apertures 31. The cross-hatched portions 44 of the spacer bars 41 comprise ledges that rest on the top of the tanks 13. The center (unhatched) portion 46 of the spacer bar rests between two tanks 13, an inch or so below the top surface of the tanks 13. The keeper cross 43 is merely a cross which rests on the center portion 46 of the spacer bar and between the inner corners of the four tanks 13 in the group.

FIG. 6*a* is a partial plan view of the spacer bar 41 and surge valve 42. The surge valve 42 is designed to let water drain downwards from the top of the flotation tanks 13, but not to let water surge upwards from the sea into the cavity between the tanks 13 and the deck 21. The surge valve 42 comprises a Weir basket 46 holding a ball float 48, the ball float closing off the aperture in spacer bar when the water level under the valve rises (i.e., "surges"). Thus the surge valve 42 provides self-bailing and is intended to prevent significant upwards pressures from reaching the deck module 12. Since the surge valve 42 closes when water surges upwards, the upward surge puts upward pressure on the spacer bar 41 and keeper cross 43. The deck module's joists 22 bear directly down on these (see FIG. 4*a*). The deck is designed to be sufficiently heavy to resist any upward force that might be transferred by the spacer bar 41 and keeper cross 43 assembly through wave actions.

FIG. 6*b* is a vertical section of FIG. 6*a* through the middle of a surge valve. As described above, the spacer bar 41 has a lower portion 46 fitting between the float tanks 13 and an upper portion 44 resting on the top surface of the surrounding tanks 13. The surge valve 42 comprises a Weir basket 47 hanging below the spacer bar 41 and a ball float 48. The ball float is shown in two positions: 48*a* closing off the valve and 48*b* with the valve open.

FIG. 6*c* shows the keeper cross 43 resting on the lower portion 46 of the spacer bar 41. The keeper cross 43 is ideally made of an impact resistant plastic or similar material and is designed to keep the spacer bars 41 aligned in their proper position and the tank 13 corners away from one another.

FIG. 7*a* is a perspective view of a twelve-member bottom bridging connector 18*b*. As shown in FIGS. 7*a* and 7*b* (top view) this connector has twelve members: four perpendicular members 71 in a single horizontal plane, four anti-torque members 72 in the same plane for connection to diagonal bottom connectors, and four skewed, diagonal members 73 angled so as to conform to the inverse pyramidal shape of the bridging network.

See FIGS. 3*a* and 3*b*, and the corresponding description, for a discussion of the use of each of the three basic types of connectors: eight-member bottom connectors, twelve-member bottom connectors, and bridging connectors.

Bottom connectors 18*a* as shown in FIGS. 3*a* and 3*b* need only eight members: four perpendicular member 71 and four skewed, diagonal members 73. The two types of bottom connectors are otherwise identical. Thus FIG. 7*a*, minus the (dashed) anti-torque members 72, is also a perspective view of an eight-member bottom connector. Note that twelve-member bottom connectors 18*b* can be used wherever an eight-member bottom connector 18*a* is needed because the extra four members will not interfere with its use.

FIG. 7*b* is a plan view of the connector shown in FIG. 7*a*. As shown, each skewed diagonal member 73 lies in the same vertical plane as an anti-torque member 72.

FIG. 7*c* is a side view of FIG. 7*b*. The angle 74 between the anti-torque member 72 and the skewed diagonal member 73 determines the ratio of the length of the bridging beam 17 to the length of the diagonal bottom beam 19*b*: one half the length of the diagonal bottom beam divided by the length of the bridging beams equals the cosine of the angle 74. The connector members are typically made of stainless steel or other corrosion resistant material and are threaded or have thread-like interspacings.

FIG. 7*d* shows a two member bridging beam connector 16 for connecting the submerged bridging network to the remainder of the modular flotation structure.

FIG. 8 is a plan view of the means of interconnection between modular flotation structures. Four modules meet at one point and are each connected by means of several pairs of bolts 54 with washers 52 and nuts 51 to the module positioned diagonally across from it. The girders are beveled at the corners to allow maneuvering room for aligning the bolt conduits 53 of the two diagonally adjacent modules. Each girder has bolt conduits 53 at several evenly spaced vertical levels so as to allow each pair of diagonal bolts 54 to be located at different vertical levels without interfering with the other pair of diagonal bolts 54. These conduits 53 are generally located near the bridging connectors 16 near the bottom of the girders 15. The bridging connectors 16 are welded to the steel reinforcing 55 in the girders 15.

FIGS. 9*a* and 9*b* show a shear block connector 61 between adjacent modular flotation structures. The shear block connectors 61 with pull-jack holes 62 provide structural support by redistributing random forces in the structure. The pull-jack holes 62 are for the attachment of a pull-jack in the event of disassembly of the main structure. The shear block connectors 61 are inserted through "cookie cutter" holes 63 in the girder walls. Numerous cookie cutter holes, in addition to those needed for shear block connectors 61, can be made in the girders 15 and beams 14 to reduce the dead weight of the modular structure. These cookie cutter holes 63 can also be used to assist in aligning adjacent modules during assembly of the main structure by means of wedging split, tapered dowels through the holes 63.

FIG. 10 shows an optional open-sea perimeter wall structure. The extra high outer wall 81 provides extra protection against rough seas. The groups of flotation tanks 82 closest to the perimeter are elongated to provide additional buoyancy to support the additional weight of the sea wall 81 and the elongated girders 83 and beams 84. Further structural support is provided by storm wave thrust beams 85 for redistributing lateral forces applied to the structure by waves. Dead weight may be removed from the storm wave thrust beams 85 and the elongated beams 84 with cookie cutter holes. Ideally, the buoyancy of the sea wall module will match the buoyancy of the other modules in the structure. The sloping deck 87 can also be used as a last chance runway to help stop runaway planes landing on the flotation structure.

The following is a brief description of one system for the construction of the modular flotation structure and its components. The float tanks 13 can be most economically fabricated by ferro cement construction. Each face is made separately with mesh reinforcing, and treated with "Xypex" waterproofing or a similar capillary sealant system. An additional phenolic coating may be appropriate for all salt water immersed surfaces. The sides are assembled and cemented together into flotation tanks.

The bridging beams 17 and both types of bottom beams 19 consist of specially reinforced concrete (ferrocement) in the form of thin-walled cement pipe, closed at each end to permit flotation. The beams should be waterproofed, as described for the float tanks. The ends of the beams are designed to permit attachment to the connectors 16 and 18.

The girders 15 and beams 14 for each module are formed as one integral piece with waterproofed, steel-reinforced concrete. Similarly, the deck modules 21 are integrally formed with the joists 22 with waterproofed, steel-reinforced concrete.

The first four or so modules to be assembled will need auxiliary flotation while being assembled. The girders 15 may be aligned initially by use of tapered dowels placed temporarily through the cookie cutter holes 63 (FIG. 9). Then the stainless steel bolts 54 may be inserted through the bolt conduits 53 and attached with stainless steel washers 52 and nuts 51. After bolting together a four by four array of sixteen modules, the dowels may be removed from the center girders of the four central modules and replaced with permanent concrete shear block connectors. Similarly, as assembly of the main structure proceeds, temporary dowels are replaced with shear block connectors only between modules which are already totally surrounded by interconnected modules. In this way interconnections between modules are kept flexible until all interconnections and alignment adjustments which might be hampered by shear block connectors have been made.

Only after the adjacent modules are interconnected are the groups of flotation tanks 13 placed in the cells adjacent to the girders. The other groups of tanks may be attached at any time.

The procedure for inserting the four tanks 13 of each group into the girder-beam gridwork is shown in FIG. 11 (the series of views proceeding left-to right and top to-bottom). Inserting the tanks one at a time, the second two tanks slip past the upper ledges 26*a* and 27*a* (see FIG. 4*a*) of the girders 15 and beams 14 by tilting each tank's tapered surface 34 against the tapered surface 34 of the first tank. After insertion each tank is interlocked between the upper and lower ledges of the beams and/or girders (see FIG. 4*a*). Finally the fourth tank is inserted by tilting it slightly toward the center of the group. The tapered sides 34 provide the space needed for the tank's lower edges to slide past the upper restraining ledges.

After the group of tanks is attached, the spacer bars 41 and keeper cross 43 are inserted and the deck module placed on top. Lift holes 23 (FIG. 4*a*) can be used to facilitate attachment of deck modules to a crane.

Alternately, as shown in FIG. 12*a*, deck modules 21 may be lifted by slings 91 if a triangular section 92 of each deck module corner is slightly recessed. FIG. 12*b* is a perspective view of the recessed corner 92. The corner is recessed both on the sides 94 and the bottom 93 to permit attachment and removal of the sling 91. FIG. 12*c* is a plan view of the recessed corner, with the dashed line 93 indicating the bottom recess. FIG. 12*d* is a section of FIG. 12*c* showing the bottom recess 93. The depth of the recesses will depend on the design of the sling, but depth of one to two inches for the side recesses 94 and two to three inches for the bottom recess 93 is anticipated.

If the reinforced concrete of the deck modules 21 has sufficient steel content, the deck modules may be lifted by electromagnets.

While the above description and drawings illustrate the preferred embodiment, many variations will occur to one skilled in the art. For example, theoretically, triangular shaped flotation tanks in hexagonal groups could be used with only minor variations in the design. Changes would be required for each major component, but none would change the concepts involved.

What is claimed:

1. A multipurpose modular floating structure comprising a plurality of modular flotation units joined together to form a reticulated pattern, each modular flotation unit comprising:

(a) at least one removable self-draining deck module with a deck surface;

(b) a plurality of flotation tanks;

(c) support means for maintaining at least one group of said flotation tanks together in position and for supporting at least one of said self-draining deck modules, (d) a submerged bridging network comprising:

1. bridging beams arranged in inverted pyramidal lattice,
2. bridging connectors for connecting said bridging beams to said support means,
3. bottom beams forming a horizontal geometric lattice with intersections corresponding to the vertices of said bridging beam pyramidal lattices,
4. bottom connectors for connecting said bottom beams to one another and to said bridging beams.

2. The structure of claim 1 wherein each modular flotation unit comprises groups of said flotation tanks, said groups arranged in a rectangular array, each said group including four of said flotation tanks.

3. The structure of claim 2 wherein said support means comprises:

girders on the perimeter of said modular floating unit, said girders retaining said groups of said flotation tanks within said modular floating unit, supporting said self-draining deck modules, connecting to the girders of other adjacent modular floating units, and connecting to the submerged briding network; and side beams for retaining groups of said flotation tanks in position within said modular floating unit and for supporting said self-draining deck modules;

said girders and side beams including ledges which interlock above and below said flotation tanks, thereby holding them in place vertically with respect to the remainder of said modular floating unit.

4. The structure of claim 3 wherein said support means further comprises:

spacer bars positioned between the upper edges of the flotation tanks in each group to resist lateral movements of the flotation tanks, a keeper cross to hold said spacer bars in alignment; and surge valves in said spacer bars to provide a drainage channel for the outflow of water.

5. The structure of claim 4 wherein each flotation tank comprises a substantially rectangular box with two contiguous sides of the four vertical sides tapered so as to be slightly narrower at the top than at the bottom;

the top having an aperture with a vertical neck and a cap for closing said aperture, said aperture allowing the addition or removal of ballast from said flotation tank;

the sides, top, bottom and neck of said flotation tank fabricated by ferro-cement construction.

6. The structure of claim 5 wherein said deck surface slopes upwards towards an outer protective wall rising vertically over the perimeter of said structure, said protective wall designed to withstand the pressure of large waves.

7. The structure of claim 6 wherein said deck module comprises an upper slab, made of reinforced concrete and having at least two lift holes and a plurality of concealed drainage ports, joists formed integrally with said upper slab, said joist positioned so as to hold said deck surface and flotation tanks in place.

8. The structure of claim 7 wherein said bottom connectors include eight-member bottom connectors and twelve-member bottom connectors, and said bottom beams include rectangular bottom beams and diagonal bottom beams, each said bottom connector having four members aligned to connect to four bridging beams which connect the four submerged corners of said support means of one modular flotation unit, thereby forming the lower vertex of an inverted pyramid, each said bottom connector further having four perpendicular members in the horizontal plane connecting to said rectangular bottom beams, each said rectangular bottom beam interconnecting two modular flotation units laterally adjacent to one another, each said twelve-member bottom connector further including four diagonal members in the horizontal plane connecting to said diagonal bottom beams, each diagonal bottom beam interconnecting two modular flotation units diagonally adjacent to one another, said eight-member and twelve-member bottom connectors interspersed in a checkerboard pattern, said diagonal bottom members thereby providing triangulation and anti-torque strength in both the horizontal and vertical planes of said submerged bridging network.

9. The structure of claim 8 wherein said modular flotation units are constructed and arranged for use as a floating airport.

10. The structure of claim 2 wherein said bottom connectors include eight-member bottom connectors and twelve-member bottom connectors, and said bottom beams include rectangular bottom beams and diagonal bottom beams, each said bottom connector having four members aligned to connect to four bridging beams which connect the four submerged corners of said support means of one modular flotation unit, thereby forming the lower vertex of an inverted pyramid, each said bottom connector further having four perpendicular members in the horizontal plane connecting to said rectangular bottom beams, each said rectangular bottom beam interconnecting two modular flotation units laterally adjacent to one another, each said twelve-member bottom connector further including four diagonal members in the horizontal plane connecting to said diagonal bottom beams, each diagonal bottom beam interconnecting two modular flotation units diagonally adjacent to one another, said eight-member and twelve-member bottom connectors interspersed in a checkerboard pattern, said diagonal bottom members thereby providing triangulation and anti-torque strength in both the horizontal and vertical planes of said submerged bridging network.

11. The structure of claim 1 wherein said modular flotation units are diagonally interconnected at the corners thereof by stainless steel bolts, inserted through conduits in reinforced corners, held in place by stainless steel washers and nuts, said conduits being precast in said corners at a plurality of vertical positions to permit crossing diagonal connectors to be positioned at different non-interfering vertical positions.

12. The structure of claim 11 further including concrete shear block connectors interconnecting laterally adjacent modular flotation units at a plurality of positions along the lateral interface of said modular flotation units, thereby redistributing random forces with said structure.

13. The structure of claim 1 wherein said deck surface slopes upwards towards an outer protective wall rising vertically over the perimeter of said structure, said protective wall designed to withstand the pressure of large waves.

14. The structure of claim 1 wherein said deck module comprises:

an upper slab, made of reinforced concrete and having at least two lift holes and a plurality of concealed drainage ports, joists formed integrally with said upper slab, said joists positioned so as to hold said deck surface and flotation tanks in place.

15. The structure of claim 1 wherein said bridging connectors and bottom connectors are constructed of stainless steel, with a plurality of threaded protruding members;

said bottom connector including members aligned to connect both to bottom beams in a horizontal lattice and to each bridging beam of one modular flotation unit;

said bridgtng connector including two members aligned to connect one submerged corner of said support means of one modular flotation unit to one bridging beam connected to said bottom connector.

16. The structure of claim 1 wherein said modular flotation units are constructed and arranged for use as a floating airport.

17. For use in a modular floating structure, a module comprising:

(a) at least one removable self-draining deck module with a deck surface;

(b) a plurality of flotation tanks;

(c) support means for maintaining at least one group of said flotation tanks together in position and for supporting at least one of said self-draining deck modules;

(d) a submerged bridging network comprising:

1. bridging beams arranged in inverted pyramidal lattice, and
2. bridging connectors for connecting said bridging beams to said support means.

18. The module in claim 17 wherein said flotation tanks are arranged in a rectangular array of groups, each group including four of said flotation tanks;

and wherein said support means comprises:

girders on the perimeter of said module, said girders retaining said groups of said flotation tanks within said module, supporting said self-draining deck modules, connecting to the girders of other adjacent modules, and connecting to the submerged bridging network; and side beams for retaining groups of said flotation tanks in position with said module and for supporting said self-draining deck modules;

said girders and side beams including ledges which interlock above and below said flotation tanks, thereby holding them in place vertically with respect to the remainder of said module.

19. For use in a modular floating structure having a multiplicity of vertical support beams thereunder in a recirculated pattern, a submerged bridging network comprising:

bridging beams arranged in an inverted pyramidal lattice;

bridging connectors for connecting said bridging beams to said support beams;

bottom beams forming a horizontal geometric lattice with intersections corresponding to the vertices of said bridging beam pyramidal lattices; and bottom connectors for connecting said bottom beams to one another and to said bridging beams;

said bottom connectors including members aligned to connect both to bottom beams in a horizontal lattice and to bridging beams in said inverted pyramidal lattice;

said bridging connectors including two members aligned to connect one submerged corner of a support beam to one bridging beam connected to a bottom connector.

* * * * *